US010347455B2

(12) United States Patent
Zhang

(10) Patent No.: US 10,347,455 B2
(45) Date of Patent: Jul. 9, 2019

(54) MINIATURE CIRCUIT BREAKER CAPABLE OF RAPID BREAKING

(71) Applicant: Hebei bao kay electric co., LTD, Baoding (CN)

(72) Inventor: Xinming Zhang, Baoding (CN)

(73) Assignee: Hebei bao kay electric co., LTD, Baoding (CN)

( * ) Notice: Subject to any disclaimer, the term of this patent is extended or adjusted under 35 U.S.C. 154(b) by 92 days.

(21) Appl. No.: 15/559,426

(22) PCT Filed: Mar. 19, 2016

(86) PCT No.: PCT/CN2016/076818
§ 371 (c)(1),
(2) Date: Sep. 19, 2017

(87) PCT Pub. No.: WO2016/146083
PCT Pub. Date: Sep. 22, 2016

(65) Prior Publication Data

US 2018/0090292 A1 Mar. 29, 2018

(30) Foreign Application Priority Data

Mar. 19, 2015 (CN) ..... 2015 1 0120242

(51) Int. Cl.
*H01H 73/02* (2006.01)
*H01H 71/24* (2006.01)
(Continued)

(52) U.S. Cl.
CPC ..... *H01H 71/2463* (2013.01); *H01H 71/08* (2013.01); *H01H 83/20* (2013.01);
(Continued)

(58) Field of Classification Search
CPC ..... H01H 71/2463; H01H 71/08; H01H 71/04
(Continued)

(56) References Cited

U.S. PATENT DOCUMENTS 5,301,083 A * 4/1994 Grass ..... H01H 71/04 335/14
9,543,083 B2 * 1/2017 Darr ..... H01H 9/104
(Continued)

FOREIGN PATENT DOCUMENTS

CN 2502400 Y 7/2002
CN 101202437 A 6/2008
(Continued)

*Primary Examiner* — Shawki S Ismail
*Assistant Examiner* — Lisa N Homza
(74) *Attorney, Agent, or Firm* — Gokalp Bayramoglu

(57) ABSTRACT

A miniature circuit breaker with quick current breaking capability which includes a miniature circuit breaker body, a current transformer CT1, a zero-sequence current transformer CT2 and a smart controller module. The miniature circuit breaker body is internally provided with a main arc extinguishing chamber, a fixed contact, a movable contact, a tripping mechanism, and a magnetic tripping push rod. The tripping mechanism includes a lock catch, a movable contact rocker arm, a jump pin, a connecting rod, and a tension spring. A rotated-hinge repulsive force structure is applied between the fixed contact and the movable contact. The tripping mechanism is further provided with a torsional spring to press the movable contact close to the fixed contact. A shunt tripping device controlling the miniature circuit breaker switch to be turned off is arranged in the smart controller module.

10 Claims, 6 Drawing Sheets

(51) Int. Cl.

| | |
|---|---|
| ***H01H 83/20*** | (2006.01) |
| ***H01H 71/08*** | (2006.01) |
| ***H01H 83/22*** | (2006.01) |
| *H01H 71/04* | (2006.01) |
| *H01H 77/10* | (2006.01) |

(52) U.S. Cl.
CPC ..... *H01H 83/226* (2013.01); *H01H 71/04* (2013.01); *H01H 77/102* (2013.01); *H01H 2083/203* (2013.01); *H01H 2219/016* (2013.01); *H01H 2227/036* (2013.01); *H01H 2235/01* (2013.01)

(58) Field of Classification Search
USPC ..... 335/21
See application file for complete search history.

(56) References Cited

U.S. PATENT DOCUMENTS

| | | | | |
|---|---|---|---|---|
| 2002/0135964 | A1* | 9/2002 | Murray | H01H 33/6661 361/131 |
| 2008/0042787 | A1* | 2/2008 | McCoy | H01H 71/04 335/186 |
| 2008/0116046 | A1* | 5/2008 | Zindler | H01H 9/342 200/306 |
| 2011/0163837 | A1* | 7/2011 | Darr | H01H 1/20 337/186 |
| 2011/0181379 | A1* | 7/2011 | Sohn | H01H 71/04 335/17 |
| 2011/0193675 | A1* | 8/2011 | Darr | H01H 1/20 337/187 |
| 2016/0301205 | A1* | 10/2016 | Lee | H02H 7/042 |
| 2017/0178829 | A1* | 6/2017 | Zhou | H01H 7/06 |
| 2018/0337015 | A1* | 11/2018 | Dore | H01H 1/2025 |
| 2019/0066959 | A1* | 2/2019 | Darr | H01H 71/123 |

FOREIGN PATENT DOCUMENTS

| | | | |
|---|---|---|---|
| CN | 101950713 | A | 1/2011 |
| CN | 104701111 | A | 6/2015 |
| CN | 204464219 | U | 7/2015 |
| EP | 1249852 | A2 | 10/2002 |

* cited by examiner

MINIATURE CIRCUIT BREAKER CAPABLE OF RAPID BREAKING

CROSS REFERENCE TO RELATED APPLICATIONS

This application is the national phase entry of International Application No. PCT/CN2016/076818, filed on Mar. 19, 2016, which is based upon and claims priority to Chinese Patent Application No. 201510120242.9, filed on Mar. 19, 2015, the entire contents of which are incorporated herein by reference.

TECHNICAL FIELD

The present invention relates to the technical field of electrical equipments, and more particularly to a circuit breaker.

BACKGROUND

The miniature circuit breaker is an important electrical element used in low voltage power distribution industry and civilian equipments and is usually used in the terminal of low-voltage power distribution system. Currently, both domestic and foreign miniature circuit breakers realize the overload and short circuit protection of current by the thermomagnetic technology principle and solution, which not only has a poor short circuit breaking capacity but also causes high energy consumption, does not have adjustable protection features, and cannot be adapted to the motor protection. Therefore, the requirement of selective protection of the system cannot be satisfied, and the reliability of power supply is low.

With the construction of smart grid and the intellectualization of power grid at the client end, higher requirements for the reliability of the end power distribution system are raised, which objectively promotes the intellectualization demands of the miniature circuit breaker. In order to achieve the requirements of selective protection of the end power distribution system, the miniature circuit breakers with different structures were made in recent years. For example, selective requirements can be partially satisfied by using the product having contact structure of internal double-loop. However, in doing so, some protective characteristics cannot be adjusted, and the motor protection is not allowable. Moreover, the method of protective tripping that uses the traditional heating element to sense the overload current fails to solve the problem of energy loss. In addition, the existing miniature residual-current circuit breaker is assembled by a miniature circuit breaker and residual current tripping module. Due to the long width of residual current tripping module, the width modulus of the miniature residual current circuit breaker is significantly increased, so the volume of the power distribution box is relatively large.

SUMMARY OF THE INVENTION

Regarding the drawbacks of the prior art, the present invention provides a miniature circuit breaker which is applied at the end of the power distribution system, occupies small volume and has low energy consumption. Moreover, the miniature circuit breaker can realize the selective protection of the end power distribution system and has a high-breaking-capacity of the short-circuit current.

To solve the above-mentioned technical problems, the technical solutions adopted by the present invention are as follows.

A miniature circuit breaker with a quick current breaking capability includes a miniature circuit breaker body, a current transformer CT1, a zero-sequence current transformer CT2, and a smart controller module. The current transformer CT1 and the zero-sequence current transformer CT2 are straddled on main-loop outgoing terminals of the miniature circuit breaker body. The smart controller module is abreast mounted beside the miniature circuit breaker body. The current transformer CT1 and the zero-sequence current transformer CT2 are connected to different input terminals of the smart controller module by a signal flat cable, respectively.

The miniature circuit breaker body is internally provided with a main arc extinguishing chamber, a fixed contact, a movable contact, a tripping mechanism, a magnetic tripping push rod, and a handle, wherein, a rotated-hinge repulsive force structure is applied between the fixed contact and the movable contact. The movable contact is mounted on the tripping mechanism through a pin shaft. The magnetic tripping push rod is arranged below the tripping mechanism. Moreover, the tripping mechanism is further provided with a torsional spring to press the movable contact closely against the fixed contact.

The smart controller module is provided with a shunt tripping device which controls a switch breaking of the miniature circuit breaker.

In the above-mentioned miniature circuit breaker with a quick current breaking capability, the tripping mechanism includes a lock catch, a movable contact rocker arm, a jump pin, a connecting rod, and a tension spring. Both the lock catch and the movable contact rocker arm are arranged on a support of a housing body of the circuit breaker through a pin shaft A. The magnetic tripping push rod is arranged on the housing body of the circuit breaker below the lock catch. The jump pin is hinged to an end of the movable contact rocker arm near the handle through a pin shaft B. The jump pin and the handle are movably connected with each other through the connecting rod. The other end of the movable contact rocker arm is hinged to a tail end of the movable contact through a pin shaft C. The tension spring is connected between a part of the movable contact rocker arm which is located between the pin shaft A and the pin shaft B and a support shaft located at a distal end of the housing body of the circuit breaker.

The tripping mechanism is further provided with a torsional spring. The torsional spring is arranged on the movable contact and the movable contact rocker arm through the pin shaft C. A head of the movable contact contacts the fixed contact closely under an action of the torsional spring when current flows through.

In the above-mentioned miniature circuit breaker with quick current breaking capability, the movable contact rocker arm is a flat-type strip-shaped structure which is arranged along a length direction of the movable contact without current flowing through. An end of the strip-shaped movable contact rocker arm near the jump pin is provided with an inverted U-shaped structure. A top end of the jump pin is hinged to an outer side supporting arm of the inverted U-shaped structure of the strip-shaped movable contact rocker arm. The connecting rod is connected to a lower portion of the jump pin.

In the above-mentioned miniature circuit breaker with quick current breaking capability, a main body of the lock catch has a H-shaped structure. The strip-shaped movable contact rocker arm is arranged in the H-shaped structure of the lock catch. An end of a lower cross-bar of the H-shaped lock catch near the handle is formed with a concave surface to engage with a lower end of the jump pin in a lap-joint. A lower end surface of the other end of the lower cross-bar corresponds with the magnetic tripping push rod. A bottom end of a vertical bar located in the middle portion of the H-shaped lock catch is hinged to a housing body support through the pin shaft A. An outer side end surface of the vertical bar located in the middle portion of the H-shaped lock catch has a concave-arcuate structure fitting with a hinge end of the movable contact.

In the above-mentioned miniature circuit breaker with quick current breaking capability, the fixed contact includes at least one flat-straight section parallel to the movable contact. A current direction in the flat-straight section of the fixed contact is opposite to a current direction in the movable contact. A length of the flat-straight section of the fixed contact is no less than the length required by a repulsive force which repels the movable contact from the fixed contact and is generated during an initial stage of a fault when a short-circuit current flows through the movable contact and the fixed contact.

In the above-mentioned miniature circuit breaker with quick current breaking capability, the miniature circuit breaker is further provided with a secondary arc extinguishing chamber.

In the above-mentioned miniature circuit breaker with quick current breaking capability, the smart controller module includes a microprocessor, an output signal amplifier, and an input signal amplifier. An input end of the input signal amplifier is connected to an output end of the current transformer CT1 and an output end of the zero-sequence current transformer CT2, respectively. An output end of the input signal amplifier is connected to an input port of the microprocessor. An input end of the output signal amplifier is connected to an output port of the microprocessor. An output end of the output signal amplifier is connected to the shunt tripping device.

In the above-mentioned miniature circuit breaker with quick current breaking capability, the smart controller module further includes an alarm display LED and a setting code switch KB. An output end of the setting code switch KB is connected to the input port of the microprocessor. An input end of the alarm display LED is connected to the output port of the microprocessor.

In the above-mentioned miniature circuit breaker with quick current breaking capability, the setting code switch KB is a keyboard matrix.

In the above-mentioned miniature circuit breaker with quick current breaking capability, the smart controller module is powered by the current transformer CT1 externally arranged on the miniature circuit breaker body.

As a result of the above technical solution, the technical improvements provided by the present invention are as follows.

The present invention is applied at the end of the power distribution system and can realize overload protection, current unbalance protection, short-circuit protection with short time delay, and short-circuit instantaneous protection, so that the short-circuit breaking capacity is improved, and the present invention provides quick current breaking. Moreover, the present invention can not only solve the problem of the miniature circuit breaker to realize the selective protection, but also solve the problem that the parameters are unadjustable so that the motor can be directly controlled and protected with the protective functions of electric leakage, grounding, etc. Compared with the traditional technology that uses a heating element and electromagnetic element to achieve the protection, the present invention can save energy. With the intellectual design of modules, the present invention not only has a variety of protective functions, but also reduces the size of the product and the manufacturing cost of the power distribution equipment.

Figure 1:
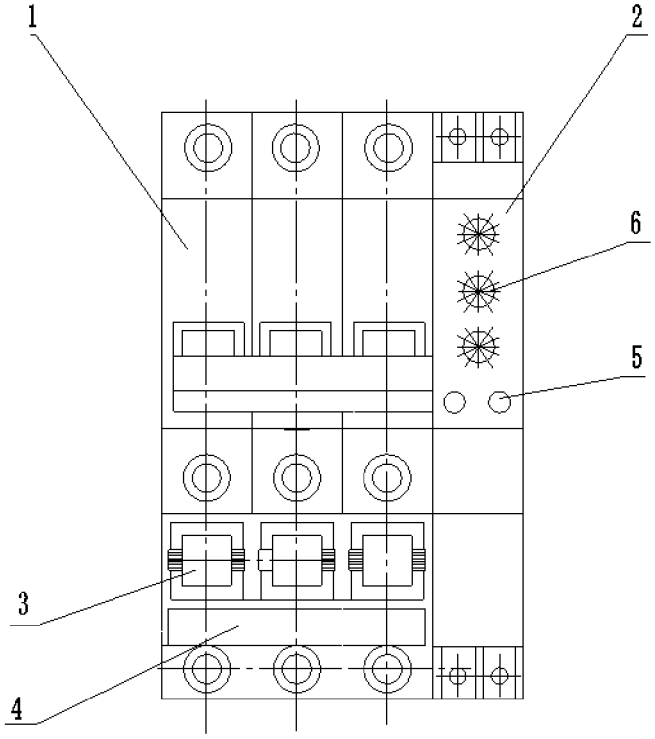
FIG. 1 is an overall structural schematic view of the present invention.

The representation of the designated references in the drawings is described below. 1, miniature circuit breaker body; 2, smart controller module; 3, current transformer CT1; 4, zero-sequence current transformer CT2; 5, alarm display LED; 6, setting code switch KB; 7, main arc extinguishing chamber; 8, fixed contact; 9, movable contact; 10, torsional spring; 11, tripping mechanism; 11-1 lock catch; 11-2 movable contact rocker arm; 11-3 jump pin; 11-4, connecting rod; 11-5 tension spring; 12, magnetic tripping push rod; 13, handle; 14, secondary arc extinguishing chamber; CPU, microprocessor; ZQ, rectifier bridge; IF, input signal amplifier; FD, output signal amplifier; TK, shunt tripping device;

A, pin shaft A; B pin shaft B; C, pin shaft C; D, lap joint between lock catch and jump pin.

DETAILED DESCRIPTION OF THE INVENTION

The invention will be described in further detail with reference to the drawings and embodiment hereinafter.

The overall structure of the present invention is shown in FIG. 1. The present invention includes miniature circuit breaker body 1, current transformer CT1, zero-sequence current transformer CT2, and smart controller module 2. The current transformer CT1 and the zero-sequence current transformer CT2 are straddled on main-loop outlet terminals of the miniature circuit breaker body. The smart controller module is abreast mounted beside the miniature circuit breaker body. The current transformer CT1 and the zero-sequence current transformer CT2 are connected to different input terminals of the smart controller module by a signal flat cable, respectively. The miniature circuit breaker in the present invention can be a single-pole breaker, a double-pole breaker, a three-pole breaker, or a four-pole breaker. In this embodiment, the miniature circuit breaker is a three-pole breaker.

The miniature circuit breaker body is internally provided with arc extinguishing chambers, a switching mechanism, and a magnetic backup protection tripping device. The arc extinguishing chambers include main arc extinguishing chamber 7 and secondary arc extinguishing chamber 14. The switching mechanism includes fixed contact 8, movable contact 9, a movable contact 9, torsional spring 10, and handle 13. The magnetic backup protection tripping device includes tripping mechanism 11, magnetic tripping push rod 12 and coils.

Figure 7:
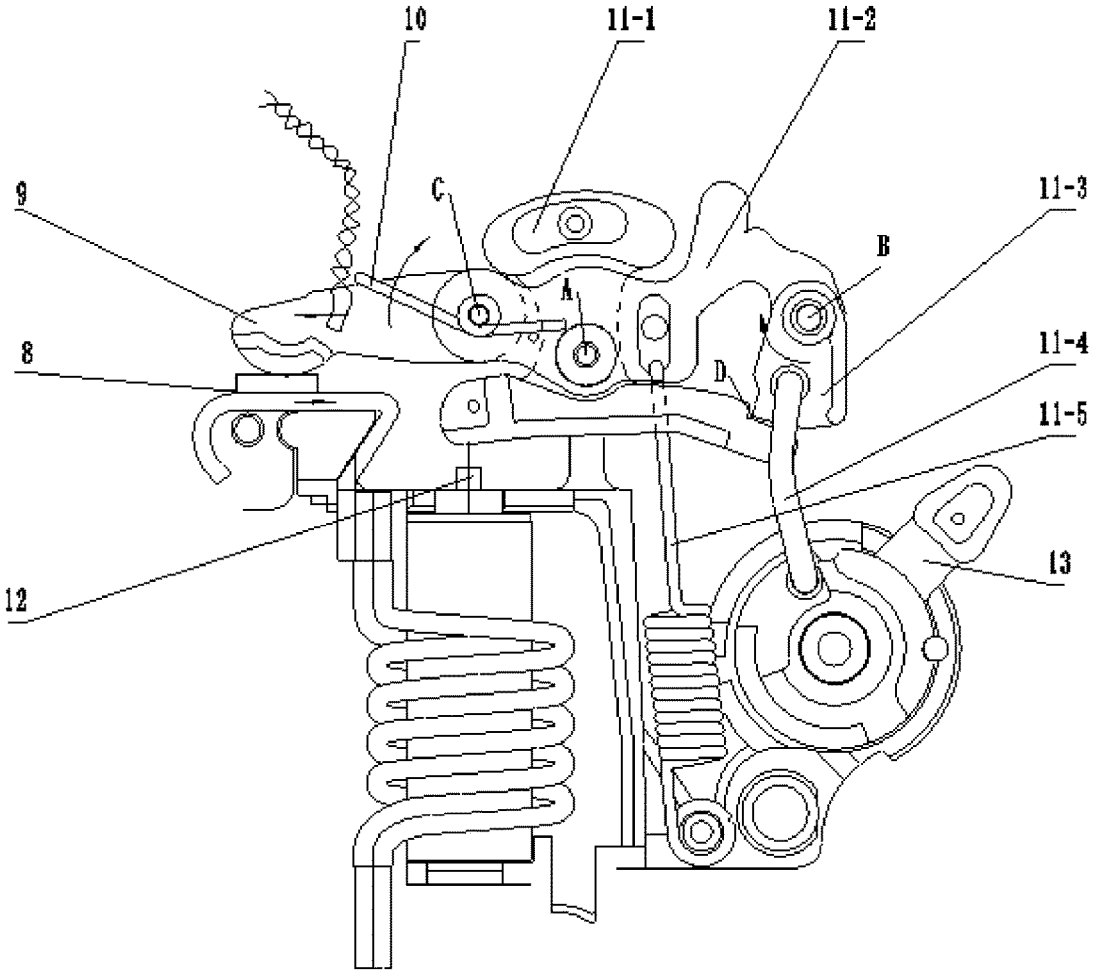
FIG. 7 is an enlarged view of a tripping mechanism of the present invention.

The structure of tripping mechanism 11 shown in FIG. 7 includes lock catch 11-1, movable contact rocker arm 11-2, jump pin 11-3, connecting rod 11-4, and tension spring 11-5. Both lock catch 11-1 and the movable contact rocker arm 11-2 are arranged on a support of a housing body of the circuit breaker through pin shaft A. Magnetic tripping push rod 12 is arranged on the housing body of the circuit breaker below the lock catch 11-1. By doing so, when there is a current flowing through the coils, the lock catch is driven to rotate clockwise around pin shaft A. Jump pin 11-3 is hinged to an end of movable contact rocker arm 11-2 near handle 13 through pin shaft B, and jump pin 11-3 can rotate in both directions. Jump pin 11-3 and handle 13 are movably connected with each other through connecting rod 11-4. The other end of movable contact rocker arm 11-2 is hinged to a tail end of movable contact 9 through pin shaft C. Tension spring 11-5 is connected between a part of movable contact rocker arm 11-2 which is located between pin shaft A and pin shaft B and a support shaft located at a distal end of the housing body of the circuit breaker. The tension spring provides a tensile force for movable contact rocker arm 11-2.

Tripping mechanism 11 of the present invention is further provided with torsional spring 10. Torsional spring 10 is arranged on movable contact 9 and movable contact rocker arm 11-2 through pin shaft C. When the switch is closed normally, a head of movable contact 9 is in close contact with fixed contact 8 under an action of the torsional spring, and a current can flow through them normally.

In the present invention, movable contact rocker arm 11-2 is a flat-type strip-shaped structure which is arranged along a length direction of movable contact 9 without any current flowing through. The position where strip-shaped movable contact rocker arm 11-2 is hinged to movable contact 9 and lock catch 11-1 is arranged as a convex-arcuate structure which extends in the width direction. An end of strip-shaped movable contact rocker arm 11-2 near the jump pin is provided with an inverted U-shaped structure. A top end of jump pin 11-3 is hinged to an outer side supporting arm of the inverted U-shaped structure of strip-shaped movable contact rocker arm. Connecting rod 11-4 is connected to a lower portion of jump pin 11-3. An upper bottom part of the inverted U-shaped structure of strip-shaped movable contact rocker arm 11-2 is provided with an arcuate antenna which corresponds to an outer end portion of lock catch 11-1.

A main body of lock catch 11-1 has a H-shaped structure. Strip-shaped movable contact rocker arm 11-2 is arranged in H-shaped structure of lock catch 11-1. A slightly upward and downward rotation of the movable contact rocker arm should be ensured in the lock catch. A small torsional spring (not shown) is mounted on pin shaft A, so that under a normal situation, the lock catch and movable contact rocker arm contact with each other at a front end of the upper cross-rod of the lock catch, and movable contact rocker arm is restricted in position. Moreover, it should be ensured that, before the tripping action of strip-shaped movable contact rocker arm 11-2 and movable contact 9, a slight clockwise rotation of clock catch 11-1 against a counter-force of the small spring can be generated, driven by magnetic tripping push rod 4, so that lock catch 11-1 and jump pin 11-3 are tripped at point D to make the entire switching mechanism trip or break.

H-shaped structure of lock catch 11-1 includes an upper cross-bar, a middle portion vertical rod, and a lower cross-bar. Each of an inner end surface of the upper cross-bar and an inner end surface of the lower cross-bar has a concave-arcuate-shaped structure fitting with the convex-arcuate-shaped structure of movable contact rocker arm 11-2. An end of the lower cross-bar of H-shaped lock catch 11-1 near handle 13 is formed with a concave surface to engage with the bottom end of jump pin 11-3 in a lap joint. A bottom surface of the other end of the lower cross-bar corresponds to the position of magnetic tripping push rod 12. A bottom end of the middle portion vertical rod of H-shaped lock catch 11-1 is hinged to the housing body support via hinge shaft A. An outer side end surface of the middle portion vertical rod has a concave-arcuate structure fitting with the hinge end of the movable contact.

A rotated-hinge repulsive force structure is applied between fixed contact 8 and movable contact 9. Fixed contact 8 includes at least one flat-straight section parallel to the movable contact. A current direction in the flat-straight section of fixed contact 8 is opposite to that is movable contact 9. The length of the flat-straight section of fixed contact 8 is no less than that of a repulsive force where the movable contact and the fixed contact repel each other due to the repulsive force generated during an initial stage of a fault when a short-circuit current flows through the movable contact and the fixed contact. When the fault occurs, the short-circuit current having opposite directions flow through the flat-straight section of the fixed contact and the movable contact, respectively. At this time, a repulsive force is formed between the fixed contact and the movable contact to repel them apart. In the present invention, the geometrical length of the flat-straight section is lengthened compared with the traditional circuit breaker, so that the parallel distance between movable contact 9 and fixed contact 8 is increased. Under the action of the short-circuit currents having different directions, a strong electric repulsive force can be generated.

Figure 2:
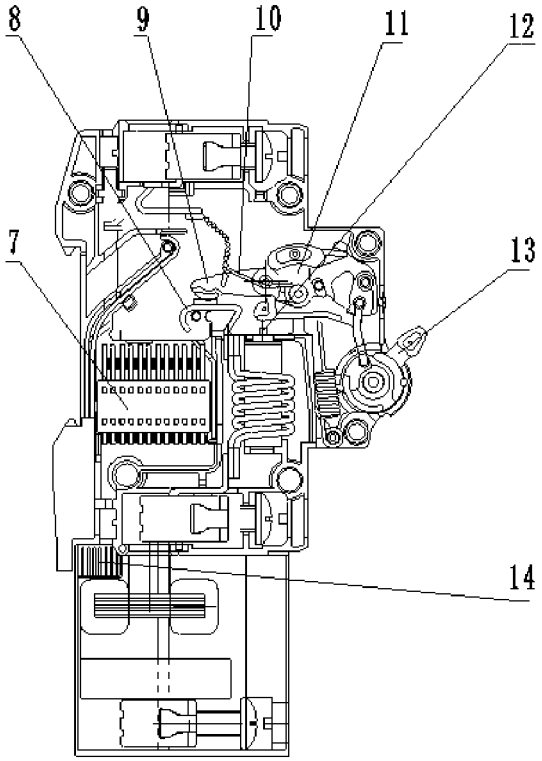
FIG. 2 is a structural schematic view of a switch of the present invention in a closed state.
Figure 3:
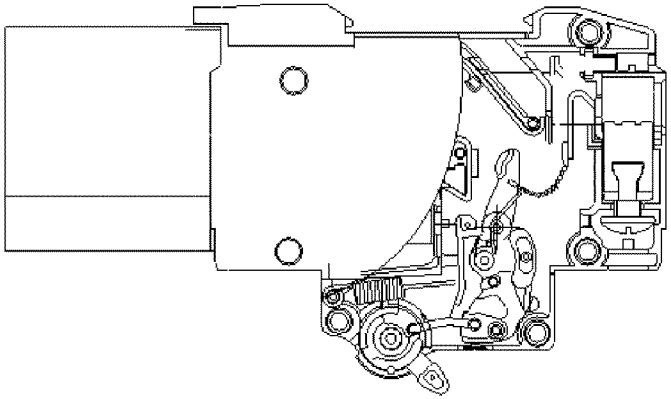
FIG. 3 is a structural schematic view of a switch of the present invention in a repulsive state.
Figure 4:
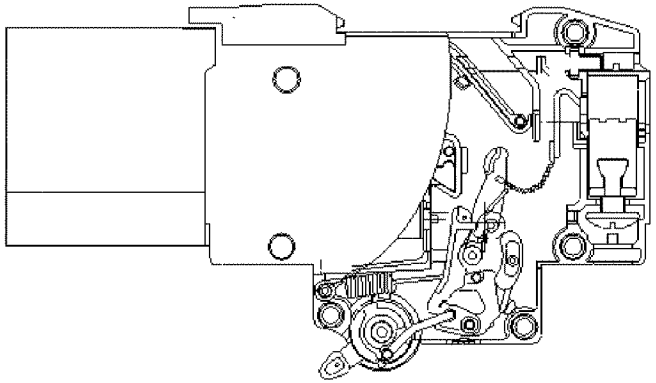
FIG. 4 is a structural schematic view of a switch of the present invention in a broken state.

Referring to FIGS. 2 to 4, a rotated-hinge repulsive force structure is applied between the movable contact and the fixed contact in the present invention, and torsional spring 10 is used to hold the contact pressure of the movable contact and the fixed contact. Moreover, when an extremely large short-circuit current occurs, an electric repulsive force would be generated to repel the movable and fixed contacts apart first, before tripping mechanism 11 completes its operation (i.e. before the short-circuit current reaches the maximum value).

The coils of the magnetic backup protection tripping device are arranged between the movable contact and the outgoing line of the circuit breaker. When an extremely large short-circuit current occurs, under the action of electric force, the movable contact and the fixed contact will be repelled apart, and the magnetic tripping push rod of the magnetic backup protection tripping device will be driven quickly under the action of the magnetic field to overcome the contour-force of the small torsional spring, so that lock catch 11-1 can generate a slight clockwise rotation. After that, the switching mechanism trips and cuts-off.

Figure 5:
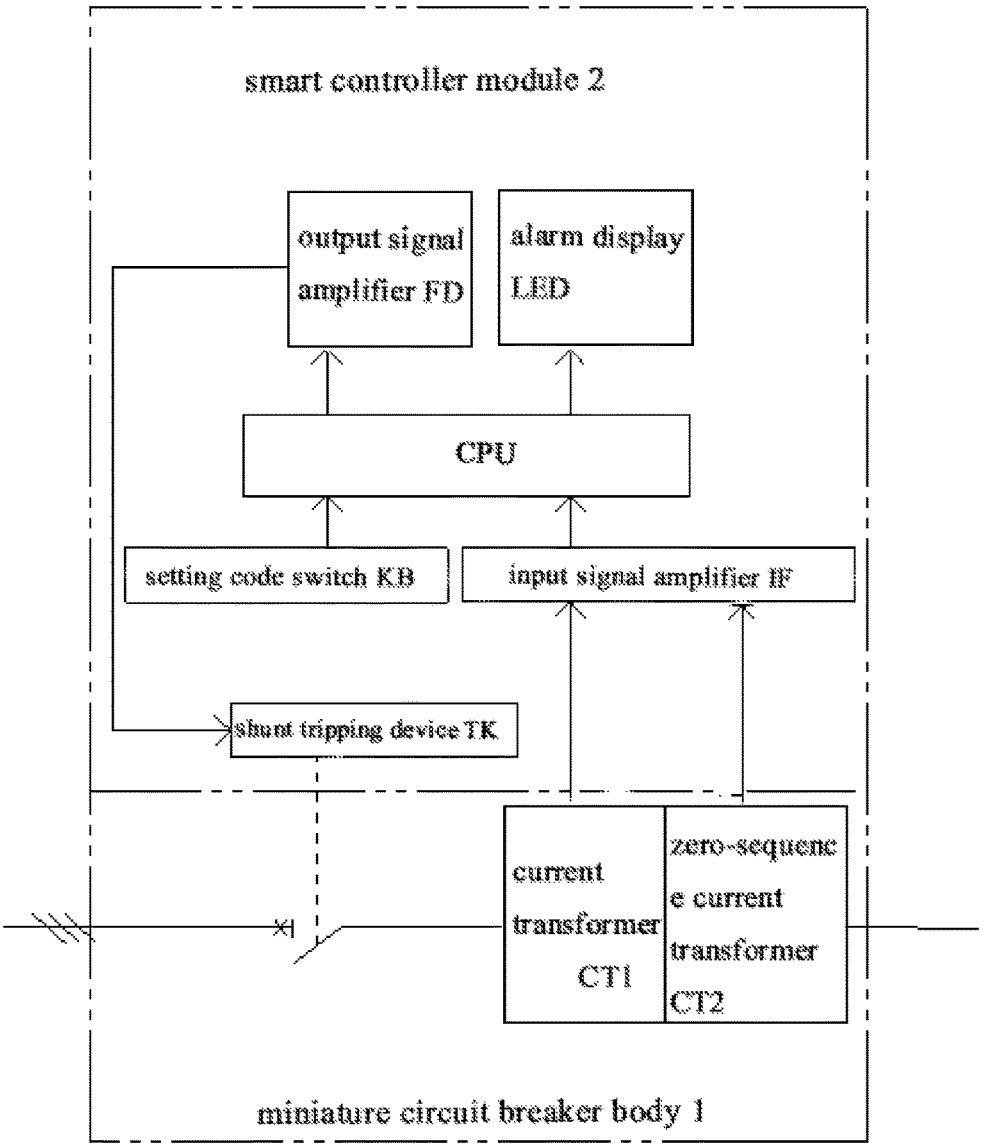
FIG. 5 is an electrical schematic diagram of the present invention.
Figure 6:
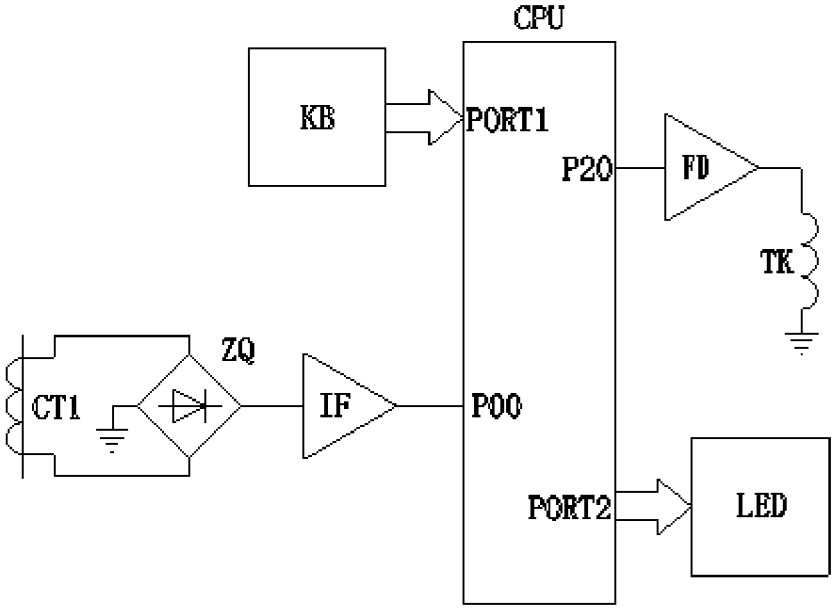
FIG. 6 is an electrical schematic diagram of a smart controller module of the present invention.

The smart controller module collects the data of overload, short circuit, etc. of the main circuit through the current transformer, and collects the leakage parameter information etc. of the main circuit through the zero-sequence current transformer. Through operation and analysis, a decision of whether to issue a command to operate the breaking of breaker will be determined, so that the existing problem that only thermo-magnetic technology, principle or solution can be used to realize the characteristics of current protection can be solved. The electrical structure diagram of smart controller module 2 is shown in FIG. 5, and the schematic diagram is shown in FIG. 6. In the present invention, the smart controller module is powered by the current transformer CT1 externally arranged on the miniature circuit breaker body 1. Apparently, the smart controller module can also be powered by the external auxiliary power to realize a double power supply.

The smart controller module includes shunt tripping device TK, microprocessor CPU, output signal amplifier FD, input signal amplifier IF, alarm display LED, and setting code switch KB. The input end of the input signal amplifier IF is connected to the output ends of the current transformers CT1 and the zero sequence current transformers CT2, respectively. The output end of the input signal amplifier IF is connected to the input port P00 of the microprocessor CPU. Moreover, rectifier bridge ZQ is arranged between input signal amplifier IF and current transformer CT1. The input port PORT1 of microprocessor CPU is further connected to setting code switch KB. The input end of the output signal amplifier FD is connected to the output port of microprocessor CPU, and the output end of output signal amplifier FD is connected to the shunt tripping device TK. The output port of microprocessor CPU is further connected to the input end of alarm display LED. In the present embodiment, the setting code switch KB is a keyboard matrix.

Specifically, microprocessor CPU can realize the function of fault protection. When faults such as overload, short circuit, electric leakage, etc. occur in the circuit, output end P20 of the CPU outputs signals of trip or trip with delayed time, so that shunt tripping device TK would operate and the miniature circuit breaker would trip. When a current close to the overload current is appeared in the circuit (i.e. pre-overloading), end PORT2 of CPU outputs alarm signal and alarm display LED alarms. The parameters of the protection property of setting code switch KB can be adjusted according to the load or requirements of the on-site power distribution system to complete the overload protection and short-circuit protection so that requirements of the on-site equipment can be satisfied.

The operation principle of the present invention is as follows.

When an extremely high short-circuit current, that hasn't reached its peak value, appears in the power distribution system, due to the different current directions in the movable contact and fixed contact, an electric repulsive force will be generated between the movable contact and fixed contact. Movable contact 9 can overcome the torsion of the torsional spring under the action of the electric force. Firstly, the movable contact will rotate clockwise around pin shaft C to repel with the fixed contact, so that the function of effectively restricting the increase of the short-circuit current in the initial stage of the short-circuit current can be realized. Subsequently, the movable push rod inside the coils of the magnetic backup protection tripping device quickly drives lock catch 11-1 of tripping mechanism 11 to rotate clockwise around pin shaft A quick under the action of the magnetic field. At this time, the lap joint of lock catch 11-1 and jump pin 11-3 in point D is tripped, and jump pin 11-3 rotates clockwise around pin shaft B after the jump pin loses support. Meanwhile, movable contact rocker arm 11-2 also loses the support of connecting rod 11-4 and rotates clockwise around pin shaft A under the action of tension spring 11-5, such that the entire tripping mechanism 11 will operate clockwise, and the switch is cut-off. Before the short-circuit current reaches its maximum value, with the repulsive force which repelled the movable contact and the fixed contact apart, the improvement of the short-circuit breaking capacity can be realized. In the present invention, when the short-circuit fault occurs in the power distribution system, the electric arc generated between the movable contact and the fixed contact is firstly cooled down and extinguished in the main arc extinguishing chamber, and then the electric arc enters the secondary arc extinguishing chamber to be further cooled down, and finally be extinguished.

When a general short-circuit current (i.e. less than a predetermined value) occurs in the power distribution system, because of the torsional spring force, the movable contact and fixed contact will not repel from each other, and the magnetic tripping push rod will not operate. At this time, the smart controller module operates in a delayed time through the shunt tripping device thereof to turn off the switch. Within the delayed time of action, the sub-breaker of the subordinate grade fault line is switched off instantaneously to cut off the fault line, so that the main circuit breaker would not be switched off, and the power supply to the subordinate grade of the main circuit breaker and the other non-fault breakers can be ensured. Therefore, the selective protection of the upper grade and lower grade can be realized.

The present invention has small volume, low energy consumption, adjustable rated current and action protection properties and is suitable for the occasions requiring different loads and can realize the selective protection function of the power distribution lines and effectively avoid the phenomenon of grade-skip trip. Therefore, the flexibility and reliability of the power distribution system can be improved. The invention can also be assembled with a miniature contactor to form a control & protection switching device CPS to control and protect the miniature motor directly.

What is claimed is:

1. A miniature circuit breaker with quick current breaking capability, comprising:

a miniature circuit breaker body, a current transformer CT1, a zero-sequence current transformer CT2, and a smart controller module; the current transformer CT1 and the zero-sequence current transformer CT2 are straddled on main-loop outgoing terminals of the miniature circuit breaker body; the smart controller module is abreast mounted beside the miniature circuit breaker body; the current transformer CT1 and the zero-sequence current transformer CT2 are connected to different input terminals of the smart controller module by a signal flat cable, respectively;

wherein the miniature circuit breaker body is internally provided with a main arc extinguishing chamber, a fixed contact, a movable contact, a tripping mechanism, a magnetic tripping push rod, and a handle, wherein, a rotated-hinge repulsive force structure is applied between the fixed contact and the movable contact; the movable contact is mounted on the tripping mechanism through a pin shaft; the magnetic tripping push rod is arranged below the tripping mechanism; the tripping mechanism is further provided with a torsional spring to press the movable contact against the fixed contact; and the smart controller module is provided with a shunt tripping device which controls a switch breaking of the miniature circuit breaker.

2. The miniature circuit breaker with quick current breaking capability of claim 1, wherein, the tripping mechanism comprises a lock catch, a movable contact rocker arm, a jump pin, a connecting rod, and a tension spring; both the lock catch and the movable contact rocker arm are arranged on a support of a housing body of the circuit breaker through a first pin shaft; the magnetic tripping push rod is arranged on the housing body of the circuit breaker below the lock catch; the jump pin is hinged to an end of the movable contact rocker arm near the handle through a second pin shaft; the jump pin and the handle are movably connected with each other through the connecting rod; the other end of the movable contact rocker arm is hinged to a tail end of the movable contact through a third pin shaft; the tension spring is connected between a part of the movable contact rocker arm that is located between the first pin shaft and the second pin shaft and a support shaft located at a distal end of the housing body of the circuit breaker;

the tripping mechanism is further provided with a torsional spring; the torsional spring is arranged on the movable contact and the movable contact rocker arm through the third pin shaft; a head of the movable contact closely contacts the fixed contact under an action of the torsional spring when the circuit breaker is switched on normally, and current flows through normally.

3. The miniature circuit breaker with quick current breaking capability of claim 2, wherein, the movable contact rocker arm is a flat-type strip-shaped structure which is arranged along a length direction of the movable contact without current flowing through; an end of the strip-shaped movable contact rocker arm near the jump pin is provided with an inverted U-shaped structure; a top end of the jump pin is hinged to an outer side supporting arm of the inverted U-shaped structure of the strip-shaped movable contact rocker arm; the connecting rod is connected to a lower portion of the jump pin.

4. The miniature circuit breaker with quick current breaking capability of claim 3, wherein, a main body of the lock catch has a H-shaped structure; the strip-shaped movable contact rocker arm is stacked in the H-shaped structure of the lock catch; an end of a lower cross-bar of the H-shaped lock catch near the handle is formed with a concave surface to engaged with a lower end of the jump pin in a lap-joint; a lower end surface of the other end of the lower cross-bar corresponds with the magnetic tripping push rod, a bottom end of a vertical bar located in the middle portion of the H-shaped lock catch is hinged to a housing body support through the pin shaft A; an outer side end surface of the vertical bar located in the middle portion of the H-shaped lock catch has a concave-arcuate structure fitting with a hinge end of the movable contact.

5. The miniature circuit breaker with quick current breaking capability of claim 4, wherein, the fixed contact comprises at least one flat-straight section parallel to the movable contact; a direction of current in the flat-straight section of the fixed contact is opposite to a direction of current in the movable contact; the length of the flat-straight section of the fixed contact is more than or equal to the length required by a repulsive force to repel the movable contact from the fixed contact and is generated during an initial stage of a fault when a short-circuit current flows through the movable contact and the fixed contact.

6. The miniature circuit breaker with quick current breaking capability of claim 5, wherein, the miniature circuit breaker is further provided with an secondary arc extinguishing chamber.

7. The miniature circuit breaker with quick current breaking capability of claim 6, wherein, the smart controller module comprises a microprocessor, an output signal amplifier, and an input signal amplifier; an input end of the input signal amplifier is connected to an output end of the current transformer CT1 and an output end of the zero-sequence current transformer CT2, respectively; an output end of the input signal amplifier is connected to an input port of the microprocessor; an input end of the output signal amplifier is connected to an output port of the microprocessor; an output end of the output signal amplifier is connected to the shunt tripping device.

8. The miniature circuit breaker with quick current breaking capability of claim 7, wherein, the smart controller module further comprises an alarm display LED and a setting code switch KB; an output end of the setting code switch KB is connected to the input port of the microprocessor; an input end of the alarm display LED is connected to the output port of the microprocessor.

9. The miniature circuit breaker with quick current breaking capability of claim 8, wherein, the setting code switch KB is a keyboard matrix.

10. The miniature circuit breaker with quick current breaking capability of claim 9, wherein, the smart controller module is powered by the current transformer CT1 externally arranged on the miniature circuit breaker body.

* * * * *